US011078043B2

(12) United States Patent
Rocher et al.

(10) Patent No.: US 11,078,043 B2
(45) Date of Patent: Aug. 3, 2021

(54) ELEVATOR OVERRUN SYSTEMS

(71) Applicant: Otis Elevator Company, Farmington, CT (US)

(72) Inventors: Jean-Emile Rocher, Gien (FR); Gerard Sirigu, Gien (FR); Jean Marie Bongibault, Loiret (FR); Guillaume Trouvain, Gien (FR); Arnaud Cazé, Chailly en Gatinais (FR); Guilhem Fournier, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 609 days.

(21) Appl. No.: 15/967,863

(22) Filed: May 1, 2018

(65) Prior Publication Data

US 2018/0327222 A1 Nov. 15, 2018

(30) Foreign Application Priority Data

May 12, 2017 (EP) ..... 17305541

(51) Int. Cl.

| | |
|---|---|
| ***B66B 5/00*** | (2006.01) |
| ***B66B 5/28*** | (2006.01) |
| ***B66B 1/28*** | (2006.01) |
| ***B66B 9/00*** | (2006.01) |

(52) U.S. Cl.

CPC ..... *B66B 5/0087* (2013.01); *B66B 1/28* (2013.01); *B66B 5/005* (2013.01); *B66B 5/0056* (2013.01); *B66B 5/282* (2013.01); *B66B 9/00* (2013.01)

(58) Field of Classification Search

CPC ..... B66B 5/0056; B66B 5/005; B66B 5/0087

See application file for complete search history.

(56) References Cited

U.S. PATENT DOCUMENTS

| | | | | |
|---|---|---|---|---|
| 6,481,534 | B1 | 11/2002 | Malone | |
| 6,736,242 | B2 | 5/2004 | Nygren | |
| 7,077,243 | B2 | 7/2006 | Huber et al. | |
| 7,832,526 | B2 | 11/2010 | Sirigu | |
| 7,891,467 | B2 * | 2/2011 | Kattainen | B66B 5/0056 187/394 |
| 8,028,808 | B2 | 10/2011 | Gonzalez et al. | |
| 8,162,108 | B2 | 4/2012 | Sirigu et al. | |

(Continued)

FOREIGN PATENT DOCUMENTS

| | | |
|---|---|---|
| CN | 201667298 U | 12/2010 |
| CN | 102030231 A | 4/2011 |

(Continued)

OTHER PUBLICATIONS

"Detailed Installation & Maintenance Guide", The Peelle Company, Guide 215.V5, May 26, 2010; 84 pages.

(Continued)

*Primary Examiner* — Diem M Tran

(74) *Attorney, Agent, or Firm* — Cantor Colburn LLP

(57) ABSTRACT

Elevator overrun systems having a first body arranged to be fixedly mounted to a portion of an elevator system or elevator shaft, a second body positioned within the first body and moveable from a deployed state to a retracted state relative to the first body, and a limit switch located at a distal end of the second body, the limit switch configured to interact with a component of an elevator system to prevent movement of an elevator car.

12 Claims, 7 Drawing Sheets

(56) References Cited

U.S. PATENT DOCUMENTS

| | | | | |
|---|---|---|---|---|
| 8,177,035 | B2 * | 5/2012 | Ueda | B66B 5/288 187/391 |
| 8,261,885 | B2 | 9/2012 | Ketoviita et al. | |
| 9,505,588 | B2 | 11/2016 | Guillot et al. | |
| 9,878,877 | B2 * | 1/2018 | Pursiainen | B66B 5/005 |
| 2015/0251876 | A1 | 9/2015 | Fauconnet et al. | |
| 2018/0229966 | A1 * | 8/2018 | Karimpanackal Natarajan | B66B 5/0068 |

FOREIGN PATENT DOCUMENTS

| | | | | |
|---|---|---|---|---|
| CN | 202124385 | U | | 1/2012 |
| CN | 205764153 | U | | 12/2016 |
| CN | 205990116 | U | | 3/2017 |
| DE | 1466853 | A1 | * | 10/2004 |
| EP | 1343712 | A1 | | 9/2003 |
| EP | 1207129 | B1 | | 1/2005 |
| EP | 1518811 | A1 | | 3/2005 |
| EP | 1538122 | A1 | | 6/2005 |
| EP | 1663839 | | | 6/2006 |
| EP | 1773704 | A1 | | 4/2007 |
| EP | 2033927 | A1 | | 3/2009 |
| EP | 2038198 | A1 | | 3/2009 |
| EP | 2075211 | | | 7/2009 |
| EP | 3012217 | A1 | | 4/2016 |
| JP | H05246647 | A | | 9/1993 |
| JP | 2002114462 | A | * | 4/2002 |
| JP | 2002145545 | | | 5/2002 |
| WO | 02051737 | A1 | | 7/2002 |
| WO | 2005105644 | A1 | | 11/2005 |
| WO | 2008002300 | A1 | | 1/2008 |
| WO | 2014049387 | A1 | | 4/2014 |

OTHER PUBLICATIONS

European Search Report, European Application No. 17305541.9, dated Nov. 10, 2017, European Patent Office; European Search Report 10 pages.

* cited by examiner

ELEVATOR OVERRUN SYSTEMS

CROSS-REFERENCE TO RELATED APPLICATIONS

This application claims the benefit of European Application No. 17305541.9, filed May 12, 2017, which is incorporated herein by reference in its entirety.

BACKGROUND

The subject matter disclosed herein generally relates to elevator systems and, more particularly, elevator overrun systems to enable maintenance on the elevator systems.

Elevator systems are installed with overtravel distances located above an elevator car at the top of an elevator shaft. During construction, installation, and maintenance of elevator systems, the overtravel distance is manually measured to ensure compliance with regulations and/or to comply with system design and/or requirements. The overtravel distance can be arranged to prevent the elevator car from rising above a specific level or distance from a ceiling/top of an elevator shaft. During maintenance, certain features of an elevator system may not be reachable when the elevator car is located at the overtravel distance. Thus, elevator overrun systems may be necessary to enable movement of the elevator car above the overtravel distance to allow for proper maintenance of elevator systems. Such elevator overrun systems can enable travel of the elevator car beyond a maximum preset position.

SUMMARY

According to some embodiments, elevator overrun systems are provided. The elevator overrun systems include a first body arranged to be fixedly mounted to a portion of an elevator system or elevator shaft, a second body positioned within the first body and moveable from a deployed state to a retracted state relative to the first body, and a limit switch located at a distal end of the second body, the limit switch configured to interact with a component of an elevator system to prevent movement of an elevator car.

In addition to one or more of the features described herein, or as an alternative, further embodiments of the elevator overrun systems may include at least one mounting bracket fixedly connected to the first body, the at least one mounting bracket arranged to mount the first body within the elevator shaft.

In addition to one or more of the features described herein, or as an alternative, further embodiments of the elevator overrun systems may include a lower contact mounted to the first body at a first location, an upper contact mounted to the first body at a second location, and a second body contact mounted to the second body, wherein when the second body contact is in contact with the lower contact the deployed state is indicated and when the second body contact is in contact with the upper contact the retracted state is indicated.

In addition to one or more of the features described herein, or as an alternative, further embodiments of the elevator overrun systems may include a securing element arranged to secure the second body to the first body in at least the deployed state.

In addition to one or more of the features described herein, or as an alternative, further embodiments of the elevator overrun systems may include that the securing element is one of attached to the first body or attached to the second body.

According to some embodiments, elevator systems are provided having elevator overrun systems as described herein.

In addition to one or more of the features described herein, or as an alternative, further embodiments of the elevator systems may include that the elevator system includes an elevator shaft having a pit and a top, a guide rail extending from the pit to the top of the elevator shaft, and an elevator car moveable along the guide rail, wherein the first body is fixedly mounted to the guide rail by the at least one mounting bracket and the elevator overrun system is positioned at the top of the elevator shaft.

In addition to one or more of the features described herein, or as an alternative, further embodiments of the elevator systems may include a car switch mounted to an exterior of the elevator car, wherein when the car switch interacts with the limit switch, the elevator car is prevented from moving along the guide rail.

In addition to one or more of the features described herein, or as an alternative, further embodiments of the elevator systems may include that the elevator car is moveable to a first level in a normal mode of operation, a second level that is higher within the elevator shaft than the first level in a maintenance mode of operation, and a third level that is higher within the elevator shaft than the second level in a maintenance mode of operation.

In addition to one or more of the features described herein, or as an alternative, further embodiments of the elevator systems may include that the elevator car is prevented from moving to the third level when the elevator overrun system is in the deployed state.

In addition to one or more of the features described herein, or as an alternative, further embodiments of the elevator systems may include a safety chain arranged to prevent movement of the elevator car within the elevator shaft when the safety chain is operated.

In addition to one or more of the features described herein, or as an alternative, further embodiments of the elevator systems may include a counterweight buffer located in the pit of the elevator shaft, wherein when the elevator overrun system is in the retracted state the counterweight buffer is compressed.

According to other embodiments, methods of operating elevator systems having elevator overrun systems are provided. The elevator overrun systems include a first body arranged to be fixedly mounted to a portion of an elevator system or elevator shaft, a second body positioned within the first body and moveable from a deployed state to a retracted state relative to the first body, and a limit switch located at a distal end of the second body, the limit switch configured to interact with a component of an elevator system to prevent movement of an elevator car. The methods include moving an elevator car within the elevator shaft to a first level, operating the elevator overrun system from the deployed state to the retracted state, and moving the elevator car to a third level that is higher in the elevator shaft than the first level.

In addition to one or more of the features described herein, or as an alternative, further embodiments of the methods may include moving the elevator car to a second level located between the first level and the third level prior to operating the elevator overrun system.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
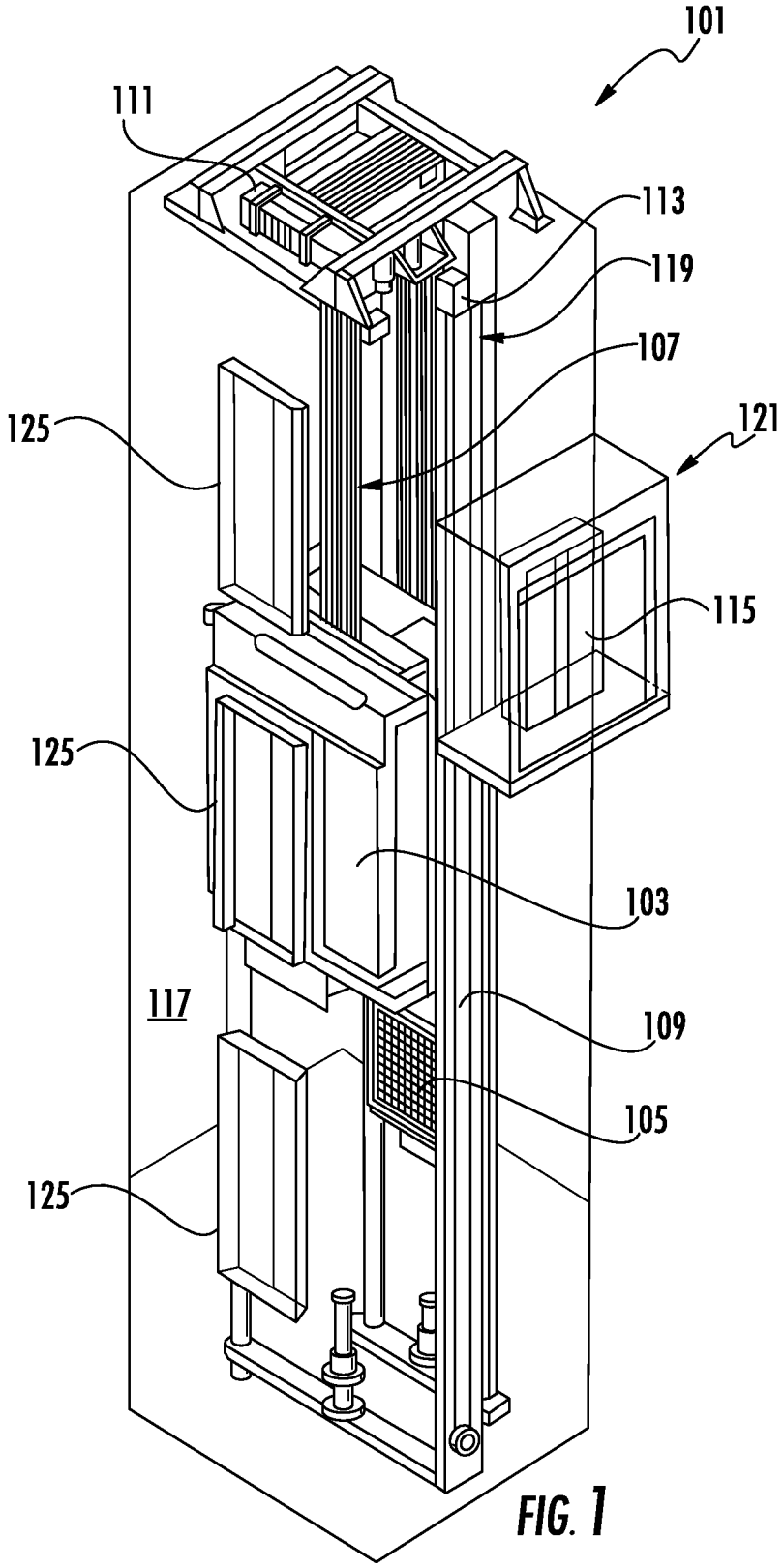
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

During construction, installation, and maintenance of elevator systems, an overrun operation may be performed to enable maintenance at a top of an elevator shaft. Some maintenance within the elevator car may require the mechanic to enter the elevator shaft on top of the elevator car. Typically, the amount an elevator car can move within an elevator shaft above a top or highest landing floor is limited for safety reasons. To move the elevator car upward from the highest landing (e.g., highest position in a normal mode of operation) the elevator system can be entered into a maintenance mode of operation. In the maintenance mode of operation, a mechanic or other authorized person can control the elevator car movement to move upward beyond the maximum normal mode of operation position. Such upward movement can be stopped at a safety position that defines a maximum maintenance position (e.g., a maximum position in the elevator shaft during a maintenance mode of operation). However, it may be advantageous and/or required for a mechanic to reach locations within the elevator shaft that are higher than the maximum maintenance position. Typically, a mechanic will be required to use a ladder or other structure while on top of an elevator car to reach higher located elements/components (e.g., elevator machine or other components). Accordingly, it may be advantageous to provide improved mechanisms and/or processes for enabling a mechanic to perform maintenance safely within an elevator shaft (and on top of the elevator car).

Figure 2C:
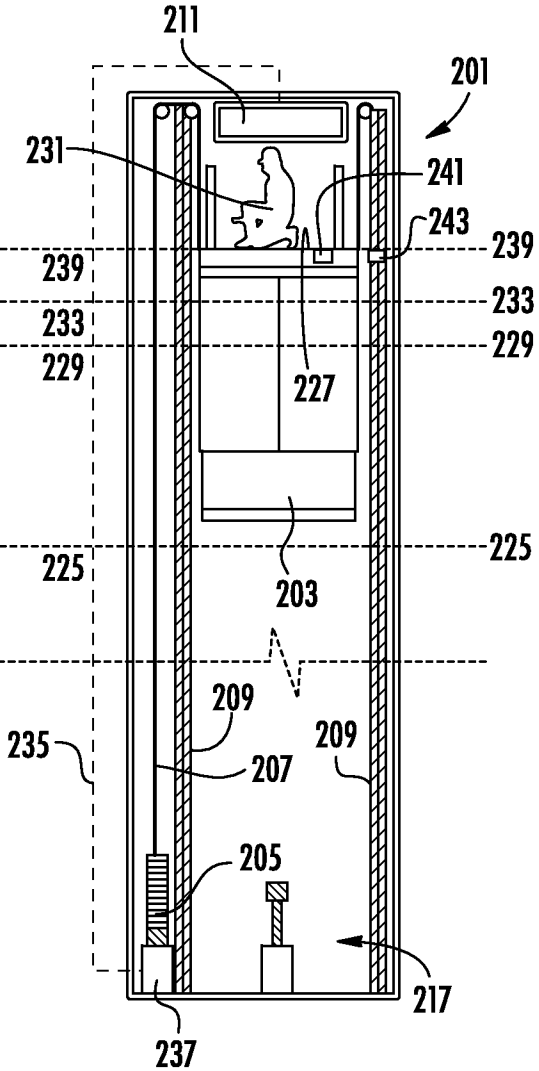
FIG. 2C is a schematic illustration of an elevator system in accordance with an embodiment of the present disclosure showing an elevator car at a third level.
Figure 2B:
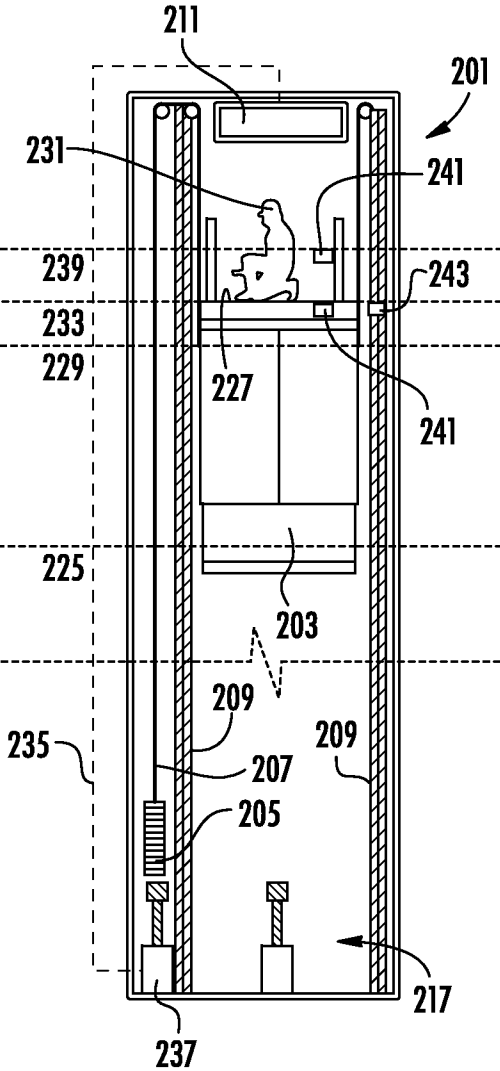
FIG. 2B is a schematic illustration of an elevator system in accordance with an embodiment of the present disclosure showing an elevator car at a second level.
Figure 2A:
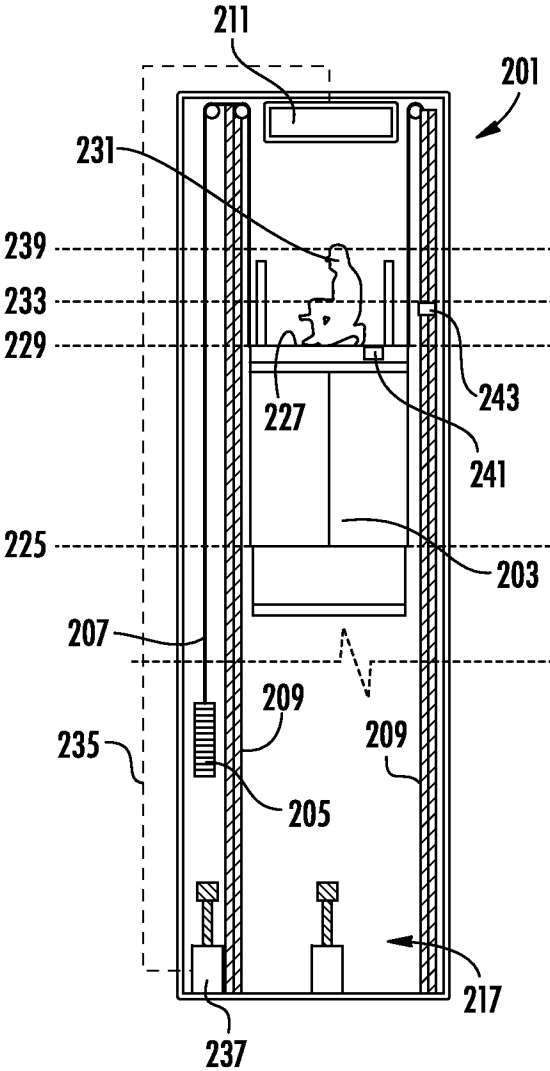
FIG. 2A is a schematic illustration of an elevator system in accordance with an embodiment of the present disclosure showing an elevator car at a first level.

Turning now to FIGS. 2A-2C, schematic illustrations of an elevator system 201 configured in accordance with an embodiment of the present disclosure are shown. The elevator system 201 is similar to that shown and described with respect to FIG. 1, the elevator system 201 including an elevator car 203 within an elevator shaft 217. Movement of the elevator car 203 is controlled by an elevator machine 211 located at the top of the elevator shaft 217, with the elevator machine 211 driving roping 207 from which the elevator car 203 and a counterweight 205 are suspended.

As shown in FIG. 2A, the elevator car 203 is located at a maximum location within the elevator shaft 217 in a normal mode of operation. Thus, as shown in FIG. 2A, the elevator car 203 is located at a top landing 225 such that passengers can load and unload from the elevator car 203. When the elevator car 203 is located at the top landing 225, a top 227 of the elevator car 203 is located at a first level 229 within the elevator shaft 217 (shown in FIG. 2A). The first level 229 is a normal maximum position of the top 227 of the elevator car 203. To access the top 227 of the elevator car 203, the mechanic 231 stops the elevator system in such a way that the top 227 of the elevator car 203 is at a level of the top landing 225. Subsequently, the mechanic 231 can access the top 227 of the elevator car 203 by opening landing doors and stepping on top of the elevator car 203. The mechanic 231 may be required to gain such access to perform maintenance within the elevator shaft 217 on elements or components of the elevator system 201 located at the top of the elevator shaft. For example, as shown, the mechanic 231 may be required to perform maintenance on the elevator machine 211 which is located within the elevator shaft 217.

However, at the first level 229, the mechanic 231 may not be able to reach the elevator machine 211 (or other components of the elevator system 201 that are located at the top of the elevator shaft 217). Accordingly, the mechanic 231 can put the elevator system 201 into a maintenance mode of operation. When in the maintenance mode of operation, the top 227 of the elevator car 203 can be moved to a second level 233 (shown in FIG. 2B), which is higher within the elevator shaft 217 than the first level 229. The second level 233 is a maintenance maximum position of the top 227 of the elevator 203. When the top 227 of the elevator car 203 is located at the second level 233, the mechanic 231 is able to access components that are higher than when in the first level 229. The elevator car 203 can be stopped at the second level 233 when a car switch 241 interacts with a limit switch 243. The car switch 241 is a mechanical and/or electrical component that is fixed to or otherwise attached to the outside of the elevator car 203, and thus moves with movement of the elevator car 203. The limit switch 243 is a mechanical and/or electrical component that is fixed to or otherwise attached at a static or fixed position within the elevator shaft 217. The limit switch 243 can be mounted to the guide rail 209 or may be mounted elsewhere within the elevator shaft 217, including, but not limited to, mounting to a wall of the elevator shaft 217.

When the car switch 241 interacts with the limit switch 243, the elevator machine 211 is stopped and thus movement of the elevator car 203 is halted. As shown in FIG. 2B, the limit switch 243 is positioned such that the limit switch 243 is triggered prior to the counterweight 205 interacting with a counterweight buffer 237. Accordingly, in the maintenance mode of operation, the mechanic 231 can move the elevator car 203 upward such that the top 227 of the elevator car 203 reaches the second level 233, but no further upward movement is possible.

That is, the second level 233 is limited by a safety chain 235 of the elevator system 201, as will be appreciated by those of skill in the art. The safety chain 235 is connected to the counterweight buffer 237 (in addition to other components as will be appreciated by those of skill in the art). The counterweight buffer 237 is located in a pit of the elevator shaft 217 (i.e., the lowest point within or floor of the elevator shaft 217). The counterweight buffer 237 is arranged such that the counterweight 205 can interact therewith the counterweight buffer 237 or a part thereof (e.g., a plunger, extension, etc.). The counterweight buffer 237 is positioned such that when the counterweight 205 reaches a predefined lowest position, the counterweight 205 interacts with the counterweight buffer 237 to activate, trigger, or trip the safety chain 235 which will stop all movement of the elevator car 203 within the elevator shaft 217. The operation of the safety chain 235 is well known and thus a detailed description will not be described herein. The counterweight 205 can interact with the counterweight buffer 237 by contacting and depressing a plunger or similar structure that provides the mechanical and/or electrical operation (e.g., activation, triggering, tripping, etc.) of the safety chain 235. The safety chain 235, as shown, is in communication between the counterweight buffer 237 and the elevator machine 211, and when triggered, the safety chain 235 can stop operation of the elevator machine 211 (or perform other safety operation, mode, or function as known in the art).

FIG. 2B illustrates the top 227 of the elevator car 203 at the second level 233, and the counterweight 205 is positioned close to but not in contact with the counterweight buffer 237. The elevator car 203 is halted by interaction of the car switch 241 and the limit switch 243 located at a fixed position within the elevator shaft 217. If the elevator car 203 is moved upward any further, the counterweight 205 (at an opposite end of the roping 207) will contact the counterweight buffer 237 thus halting upward movement of the top 227 of the elevator car 203 above the second level 233. The allotted upward movement (e.g., to the second level 233) can be achieved in a maintenance mode of operation, wherein the mechanic 231 moves the elevator car 203 upward and the counterweight 205 similarly moves downward until the car switch 241 interacts with the limit switch 243.

However, if the counterweight 205 contacts the counterweight buffer 237, the safety chain 235 is triggered, even in a maintenance mode of operation, and the elevator car 203 is prevented from moving. Thus, even in a normal maintenance mode of operation, only a limited reach can be achieved by the mechanic 231. However, certain components of the elevator system 201, such as the elevator machine 211, may be located out of reach of the mechanic 231 even when the top 227 is located at the second level 233. Accordingly, the mechanic 231 may need a ladder or other structure to reach such components, which may be difficult and/or dangerous.

However, in accordance with embodiments of the present disclosure, and as shown in FIG. 2C, the top 227 of the elevator car 203 can be moved to a third level 239. The third level 239 is a position within the elevator shaft 217 that is higher than both the first level 229 and the second level 233. The third level 239 is a maximum elevator position that is the highest extent that the elevator car 203 can travel within the elevator shaft 217. The third level 239 is obtainable when the elevator system 201 is in a maintenance mode of operation and is controlled by the mechanic 231 located on the top 227 of the elevator car 203, and an overrun operation is performed as described herein. The overrun operation enables movement of the elevator car 203 beyond typical or built-in safety limits of movement and operation of the elevator system 201.

As shown in FIG. 2C, the counterweight 205 has moved downward against and compressed the counterweight buffer 237, which is typically not possible in normal operation or normal maintenance operation—as the counterweight buffer 237 trips the safety chain 235 and the elevator car 203 cannot move further upward (and thus the counterweight 205 cannot move so far downward). Accordingly, to achieve such further upward movement to the third level 239, the safety chain 235 must be deactivated, at least with respect to being triggered by the counterweight buffer 237. To achieve such deactivation, the car switch 241 and/or the limit switch 243 must be altered or deactivated. For example, in accordance with embodiments of the present disclosure, the physical position of the limit switch can be adjusted to enable further upward movement of the top 227 of the elevator car 203 beyond the second level 233 to reach the third level 239.

With the limit switch 243 adjusted in position (as shown in FIG. 2C), the elevator car 203 can be moved upward such that the top 227 of the elevator car 203 reaches the third level 239. In the third level 239, the mechanic 231 can readily and easily reach and perform maintenance on components/elements located at the highest points within the elevator shaft 217, such as the elevator machine 211.

Figure 3A:
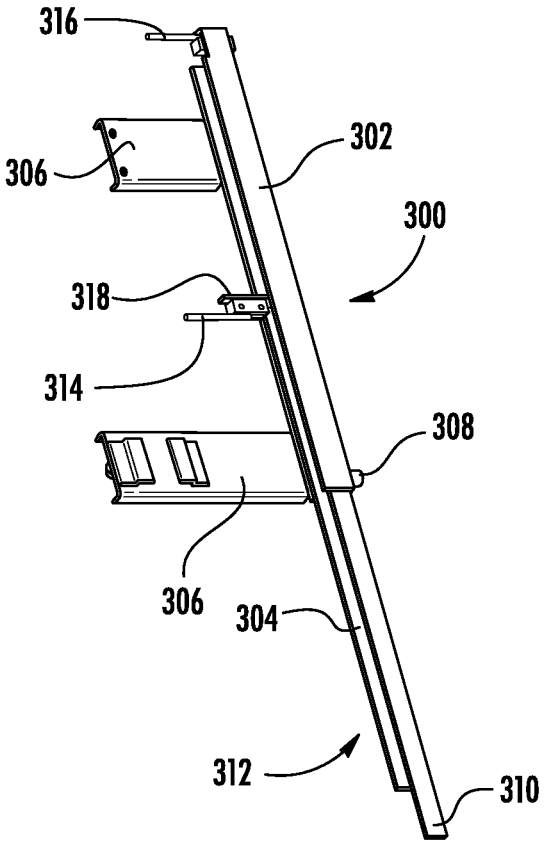
FIG. 3A is a schematic illustration of an elevator overrun system in accordance with an embodiment of the present disclosure, shown in a deployed state.
Figure 3B:
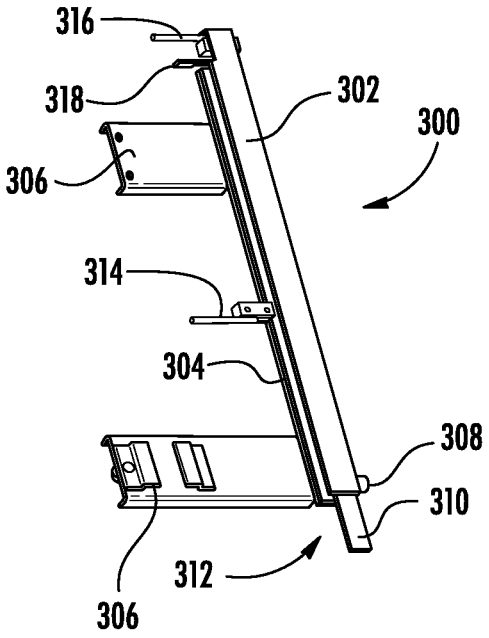
FIG. 3B is a schematic illustration of the elevator overrun system of FIG. 3A shown in a retracted state.

Turning now to FIGS. 3A-3B, schematic illustrations of components of an elevator overrun system 300 in accordance with an embodiment of the present disclosure are shown. The elevator overrun system 300 enables a mechanic to operate an elevator system such that a top of an elevator car can reach a maximum elevator position (e.g., third level 239 shown in FIGS. 2A-2C). Such action may be performed to enable the mechanic to easily and safely perform maintenance at the top of an elevator shaft.

The elevator overrun system 300 includes a first, fixed body 302 and a second, moveable body 304, with the moveable body 304 moveable relative to the fixed body 302. The first body 302 is mounted to a fixed structure within an elevator shaft, such as a guide rail, support beam, wall, etc. The mounting of the first body 302 can be achieved by use of one or more optional mounting brackets 306. In some embodiments, the first body 302 can be mounted directly to a structure within the elevator shaft, and still in another embodiment, the first body 302 can be integrally formed with or part of a structure of the elevator system.

FIG. 3A illustrates the second body 304 in a deployed or extended state. That is, in the deployed state, the second body 304 extends from the first body 302. The second body 304 can be secured or locked in the deployed state using a securing element 308. The securing element 308 can be a fastener, movable plunger, indexing plunger, pin, etc., as will be appreciated by those of skill in the art. In some embodiments, the securing element 308 can be fixed to the first body 302 and/or the mounting bracket 306 and the second body 304 can include a number of positioning holes or apertures that are engageable by the securing element 308 to secure the second body 304 relative to the first body 302. In other embodiments, the securing element 308 can be fixed to or part of the second body 304, with the securing element 308 engageable with a feature of the first body 302. Further, in some embodiments, the securing element 308 can be completely removable from both the first and second bodies 302, 304, such as in the form of a pin that passes through and engages within aligned apertures or holes of the two bodies 302, 304.

The moveable second body 304 includes a limit switch 310 on a distal end 312 thereof. The distal end 312 of the second body 304 is the end of the second body 304 that is farthest from the first body 302. The limit switch 310 can be a mechanical device or structure and/or an electrical component. In some embodiments, the limit switch 310 on the distal end 312 of the second body 304 is an extension of the material of the second body 304, e.g., an arm, flange, etc. In other embodiments, the limit switch 310 can be an electrical, mechanical, optical, magnetic, or other type of component or actuator that is arranged and selected such that it can interact with a car switch that is mounted to an elevator car (e.g., car switch 241 of FIGS. 2A-2C). That is, the arrangement, structure, and configuration of the limit switch 310 on the distal end 312 of the second body 304 is not to be limited and can take any form, either active interaction (e.g., electrical) or passive (e.g., physical block or structure that contacts a car switch).

When the limit switch 310 interacts with a car switch located on an elevator car, movement of the elevator car can be prevented. That is, the limit switch 310 is a safety mechanism (or part of a safety mechanism) that is arranged to prevent improper movement of an elevator car. The limit switch 310 can be arranged to stop movement of an elevator car at a maximum maintenance position (e.g., second level 233 shown in FIGS. 2A-2C). However, as noted above, it may be desirable or advantageous to move the elevator car higher within an elevator shaft, such as to perform maintenance on components at the top of an elevator shaft (e.g., elevator machine).

FIG. 3B illustrates the elevator overrun system 300 in a retracted state, with the second body 304 retracted into the first body 302. As shown, the limit switch 310 is moved relative to the first body 302 which is fixed in place (e.g., mounted to a guide rail), e.g., upward when installed in an elevator system. Accordingly, an elevator car will be able to move upward further before an associated car switch interacts with the limit switch 310, as described herein. To move to the retracted state, a mechanic can actuate or otherwise use the securing element 308 to disengage the second body 304 from the first body 302, and then move the second body 304 relative to the first body 302 from the deployed state (FIG. 3A) to the retracted state (FIG. 3B). When in the retracted state, the elevator overrun system 300 allows for additional upward movement of an elevator car within an elevator shaft. In some embodiments, when the limit switch 310 is moved, a counterweight can be moved into contact with and depress a portion of a counterweight buffer without triggering or tripping a safety chain of the elevator system. However, as will be appreciated by those of skill in the art, and as described herein, the limit switch 310 is always present, and thus, even in the retracted state (FIG. 3B), the limit switch 310 can trigger the safety chain to prevent further upward movement of the elevator car.

Also shown in FIGS. 3A-3B, the elevator overrun system 300 includes a lower contact 314 and an upper contact 316 that are part of, mounted to, or positioned relative to the first body 302 at two locations that indicate the deployed state (first location, lower contact 314, FIG. 3A) and the retracted state (second location, upper contact 316, FIG. 3B). The second body 304 includes a second body contact 318 that is fixedly attached to or part of the second body 304 and is movable therewith. When the second body 304 is in the deployed state, the second body contact 318 is in contact with the lower contact 314 and when the second body 304 is moved to the retracted state, the second body contact 318 is in contact with the upper contact 316. The contacts 314, 316, 318 can be arranged to detect a position of the second body 304 relative to the first body 302. If the second body 304 is retracted and in the retracted state, the upper contact 316 is activated by contact with the second body contact 318 and it is not possible to move an elevator car in a normal operation (e.g., limits operation to maintenance mode of operation). However, when the second body 304 is in the deployed state and deployed or extended, the second body contact 318 is in contact with the lower contact 314 and the elevator car can be operated in a normal mode of operation. That is, if the second body contact 318 is not in contact with the lower contact 314 of the first body 302, then the elevator system cannot be put into a normal mode of operation.

Figure 4A:
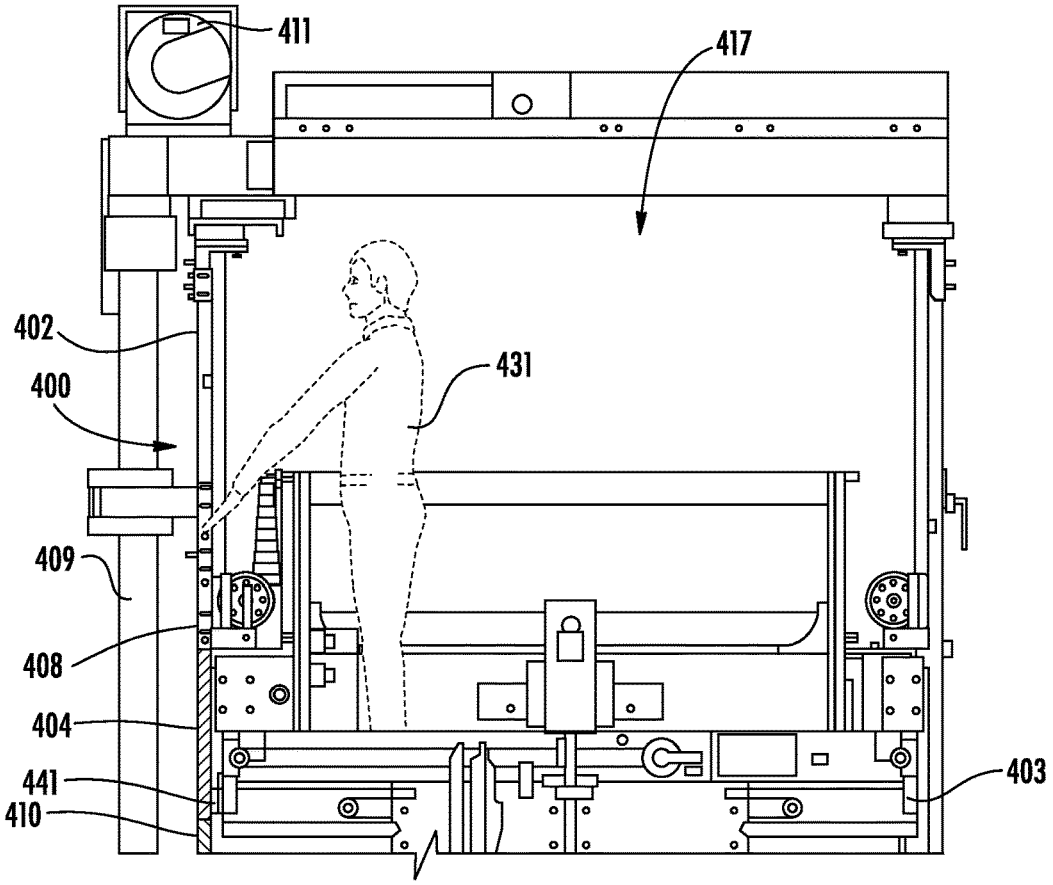
FIG. 4A is a side elevation illustration of an elevator system equipped with an elevator overrun system in accordance with an embodiment of the present disclosure, showing the elevator overrun system in a deployed state.
Figure 4B:
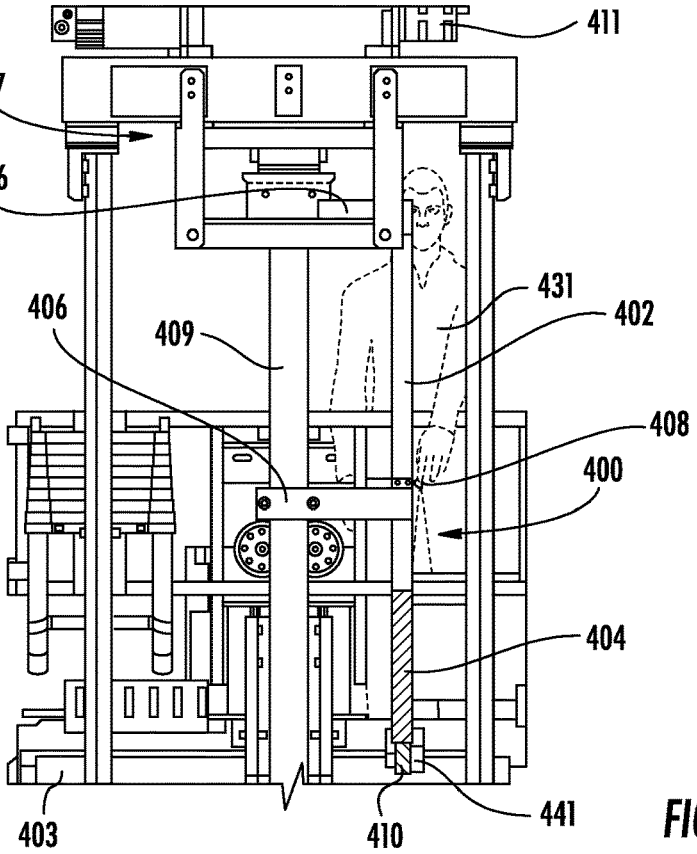
FIG. 4B is a front elevation illustration of the illustration of FIG. 4A.
Figure 4C:
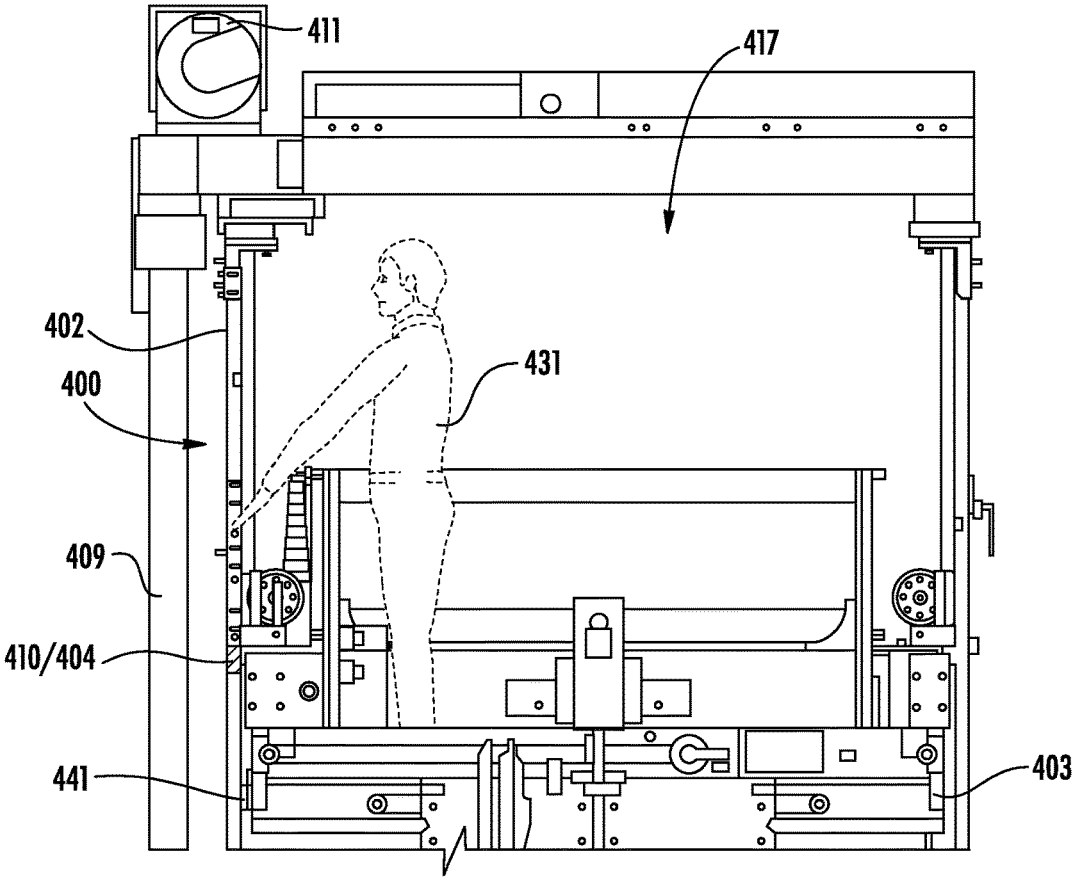
FIG. 4C is a side elevation illustration of the elevator system of FIG. 4A, showing the elevator overrun system in a retracted state.
Figure 4D:
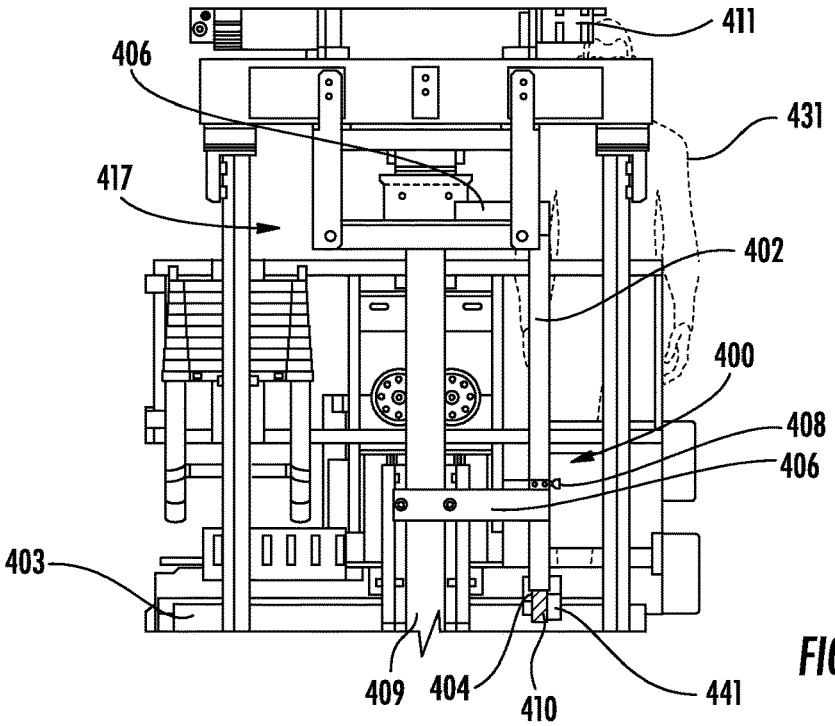
FIG. 4D is a front elevation illustration of the elevator car of the elevator system of FIG. 4A moved to a maximum elevator position with the elevator overrun system in the retracted state.
Figure 4E:
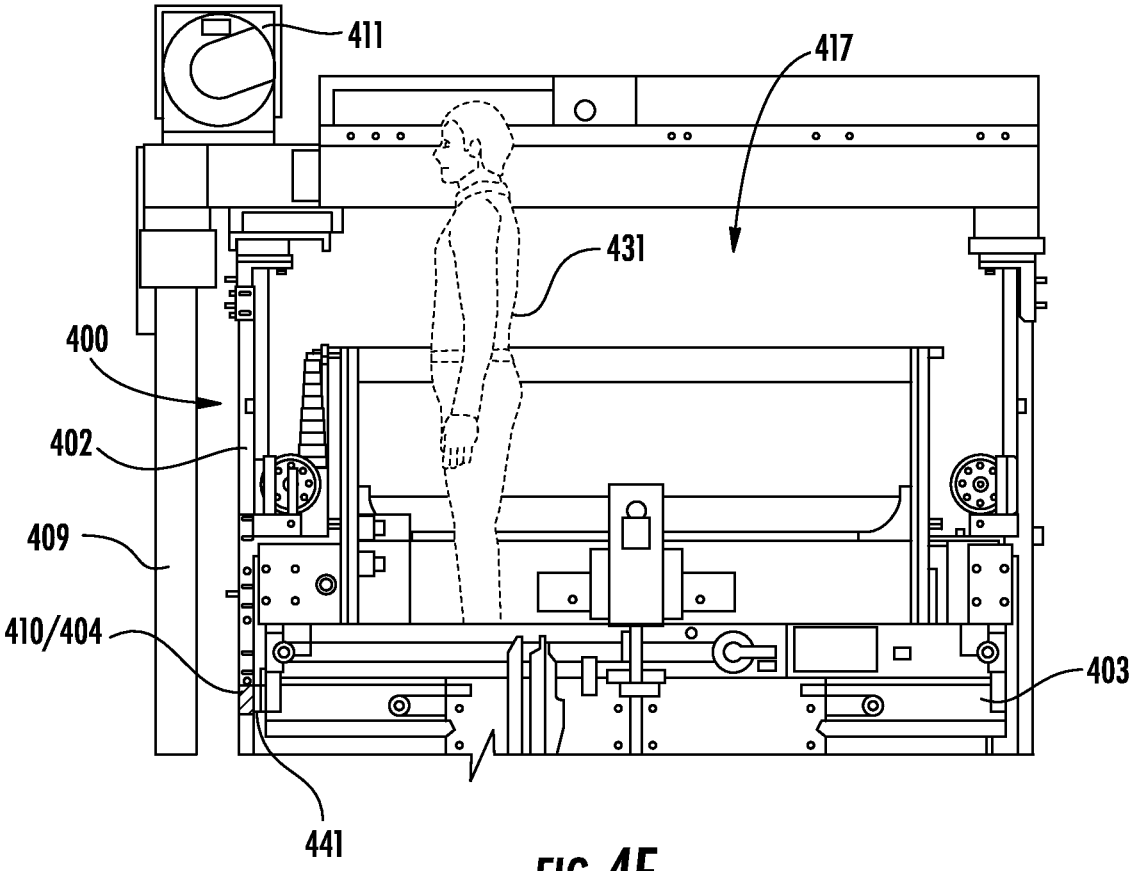
FIG. 4E is a side elevation illustration of FIG. 4D.

Turning now to FIGS. 4A-4E, schematic illustrations of a mechanic 431 on top of an elevator car 403 using an elevator overrun system 400 in accordance with an embodiment of the present disclosure are shown. FIG. 4A is a side elevation illustration with the elevator car 403 located at a maintenance maximum position (e.g., second level 233 in FIGS. 2A-2C) and the elevator overrun system 400 is in a deployed state. FIG. 4B is a front elevation illustration of the illustration of FIG. 4A. FIG. 4C is a side elevation illustration with the elevator overrun system 400 is in a retracted state (prior to being moved upward). FIG. 4D is a front elevation illustration of the elevator car moved to a maximum elevator position (e.g., third level 239 in FIGS. 2A-2C) and the elevator overrun system 400 is in the retracted state. FIG. 4E is a side elevation illustration of FIG. 4D.

As shown in FIGS. 4A-4E, the mechanic 431 is located on top of the elevator car 403 and may desire to perform maintenance on an elevator machine 411 of other elevator system component that is located at a top of an elevator shaft 417. The elevator car 403 includes a car switch 441 that is configured to interact with a portion of the elevator overrun system 400 and prevent movement of the elevator car 403. The elevator overrun system 400 is mounted to a guide rail 409 by mounting brackets 406.

The elevator overrun system 400 is similar to that shown and described above, including a first body 402 and a second body 404 that is moveable relative to the first body 402. The first body 402 is fixedly positioned within an elevator shaft by the mounting brackets 406. The second body 404 includes a limit switch 410 that is similar in function and structure to that described above. The limit switch 410 is arranged to interact with the car switch 441 to prevent movement of the elevator car 403 when the two switches 410, 441 interact.

As shown in FIGS. 4A-4B, the elevator overrun system 400 is in a deployed state, with the second body 404 secured to the first body 402 by a securing element 408. The mechanic 431 can operate the securing element 408 to unlock or release the second body 404 from the first body 402, to thus move the second body 404 relative to the first body 402 and into the retracted state, as shown in FIGS. 4C-4E. With the elevator overrun system 400 in the retracted state, the limit switch 410 is no longer in contact or interaction with the car switch 441, and thus the elevator car 403 can be moved upward into the maximum elevator position as shown in FIG. 4E. In this position, the mechanic 431 can easily and safely perform maintenance on the elevator machine 411 or other components/elements of an elevator system that are located at the top of the elevator shaft 417. It will be appreciated that the limit switch 410 can interact with the car switch 441 in the position shown in FIGS. 4D-4E (e.g., top position). In this instance, a safety chain will be triggered by interaction of the limit switch 410 and the car switch 441 such that further upward motion of the elevator car cannot be achieved.

Figure 5:
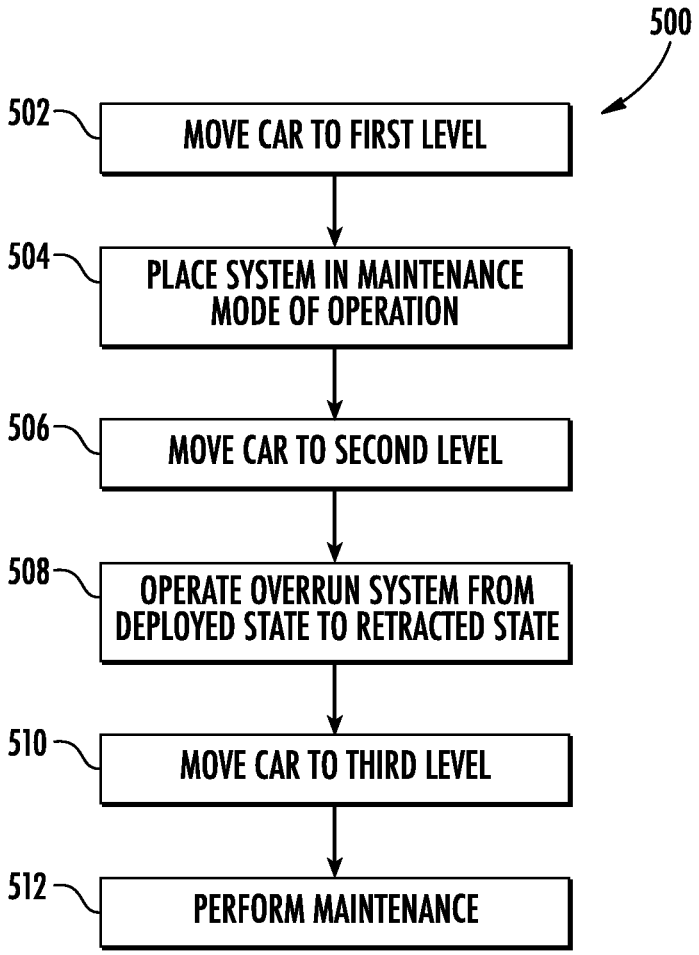
FIG. 5 is a flow process for performing an overrun operation in accordance with an embodiment of the present disclosure.

Turning now to FIG. 5, a flow process 500 for performing an overrun operation to enable maintenance at a top of an elevator shaft in accordance with an embodiment of the present disclosure is shown. The overrun operation can be performed using an elevator system as shown and described above, having an elevator car moveable along one or more guide rails within an elevator shaft, and an elevator overrun system located at a top of the elevator shaft. The overrun operation can be initiated by a mechanic or other person when it is desirable to perform maintenance at a top of an elevator shaft, such as to inspect or repair an elevator machine of the elevator system.

At block 502, the elevator car is moved to the top landing within an elevator shaft, and thus a top of the elevator car can be positioned at a first level, e.g., a normal maximum position during normal operation of the elevator. The movement of the elevator car can be controlled by a control unit that is used to put the elevator system in a maintenance mode of operation and initiation of the overrun operation may be performed. In some configurations, block 502 can be omitted if the elevator car is already located at the top landing prior to initiation of the flow process 500.

At block 504, the elevator system is placed into a maintenance mode of operation. In some embodiments, block 502 can be performed prior to block 504, or in other embodiments, block 502 and block 504 can be performed simultaneously. At the same time, or before or after block 502 and block 504, a mechanic may climb on top of the elevator car.

At block 506, the elevator car is moved upward beyond the first level to a second level, the second level being a maximum maintenance position of the elevator car within the elevator shaft. The second level can be controlled by various safety features, including, but not limited to, a limit switch of the elevator overrun system in the deployed state and/or a safety chain, as will be appreciated by those of skill in the art. The elevator car may be driven slowly such that the upward motion of the elevator car is minimal and such that no damage may come to the elevator system and/or injury to a mechanic located on top of the elevator car.

At block 508, the mechanic can operate the elevator overrun system to move a second body relative to a first body, and thus move a location of a limit switch, as shown and described above. That is, at block 508, the elevator overrun system can be actuated or otherwise operated from the deployed state to a retracted state.

At block 510, the elevator car can then be moved to a third level, which is a maximum elevator position within the elevator shaft. The third level can be defined by a car switch of the elevator car interactive with the moved limit switch of the elevator overrun system. Again, the elevator car may be driven slowly such that the upward motion of the elevator car is minimal and such that no damage may come to the elevator system and/or injury to a mechanic located on top of the elevator car. As described above, to enable the elevator car to be able to move to the third level, the counterweight is lowered into contact with counterweight buffer and compressing such buffer. Such contact and compression is enabled because the system described herein disables the safety change for the present operation.

At block 512, the mechanic can perform a maintenance operation or task at the highest position within the elevator shaft in a safe manner.

Those of skill in the art will appreciate that the flow process 500 can be reversed to bring the elevator car back to the first level, and then the elevator system can be returned to a normal mode of operation. Further, in some embodiments, certain steps may be omitted or additional steps may be added, without departing from the scope of the present disclosure. For example, in one non-limiting example, the second level can be omitted entirely, such that the elevator car is moved from the first level directly to the third level.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator overrun system comprising:

a first body arranged to be fixedly mounted to a portion of an elevator shaft;

a second body movably arranged within the first body and slidable from a deployed state to a retracted state to within the first body;

a limit switch located at a distal end of the second body, the limit switch configured to interact with a car switch arranged on an exterior of an elevator car to prevent movement of the elevator car, wherein the car switch is at least one of mechanical and electrical; and a second body contact located at an end of the second body opposite the distal end, wherein the first body includes a lower contact at a first location and an upper contact at a second location, wherein the second body contact is slidable along the first body between contact with the lower contact of the first body in the deployed state and contact with the upper contact of the first body in the retracted state, and wherein the physical position of the limit switch is adjusted within the elevator shaft when transitioning between the deployed state and the retracted state.

2. The elevator overrun system of claim 1, further comprising at least one mounting bracket fixedly connected to the first body, the at least one mounting bracket arranged to mount the first body within the elevator shaft.

3. The elevator overrun system of claim 1, further comprising a securing element arranged to secure the second body to the first body in at least the deployed state.

4. The elevator overrun system of claim 3, wherein the securing element is one of attached to the first body or attached to the second body.

5. An elevator system comprising:

a first body arranged to be fixedly mounted to a portion of an elevator shaft of the elevator system;

a second body movably arranged within the first body and slidable from a deployed state to a retracted state to within the first body; and a limit switch located at a distal end of the second body, the limit switch configured to interact with a car switch arranged on an exterior of an elevator car to prevent movement of the elevator car, wherein the car switch is at least one of mechanical and electrical; and a second body contact located at an end of the second body opposite the distal end, wherein the first body includes a lower contact at a first location and an upper contact at a second location, wherein the second body contact is slidable along the first body between contact with the lower contact of the first body in the deployed state and contact with the upper contact of the first body in the retracted state, and wherein the physical position of the limit switch is adjusted within the elevator shaft when transitioning between the deployed state and the retracted state.

6. The elevator system of claim 5, wherein the elevator shaft has a pit and a top, the elevator system comprising:

a guide rail extending from the pit to the top of the elevator shaft; and at least one mounting bracket fixedly connected to the first body;

wherein the elevator car is moveable along the guide rail, and wherein the first body is fixedly mounted to the guide rail by the at least one mounting bracket and the elevator overrun system is positioned at the top of the elevator shaft.

7. The elevator system of claim 6, wherein the elevator car is moveable to a first level in a normal mode of operation, a second level that is higher within the elevator shaft than the first level in a maintenance mode of operation, and a third level that is higher within the elevator shaft than the second level in the maintenance mode of operation.

8. The elevator system of claim 7, wherein the elevator car is prevented from moving to the third level when the elevator overrun system is in the deployed state.

9. The elevator system of claim 6, further comprising a safety chain arranged to prevent movement of the elevator car within the elevator shaft when the safety chain is operated.

10. The elevator system of claim 6, further comprising a counterweight buffer located in the pit of the elevator shaft, wherein when the elevator overrun system is in the retracted state the counterweight buffer is compressed.

11. A method of operating an elevator system having an elevator overrun system including a first body arranged to be fixedly mounted to a portion of an elevator shaft, a second body movably arranged within the first body and slidable from a deployed state to a retracted state within the first body, a limit switch located at a distal end of the second body, the limit switch configured to interact with a car switch arranged on an exterior of an elevator car to prevent movement of the elevator car, wherein the car switch is at least one of mechanical and electrical, and a second body contact located at an end of the second body opposite the distal end, wherein the first body includes a lower contact at a first location and an upper contact at a second location, wherein the second body contact is movable along the first body between contact with the lower contact of the first body in the deployed state and contact with the upper contact of the first body in the retracted state, and wherein the physical position of the limit switch is adjusted within the elevator shaft when transitioning between the deployed state and the retracted state, the method comprising:

moving the elevator car within the elevator shaft to a first level;

operating the elevator overrun system from the deployed state to the retracted state; and moving the elevator car to a third level that is higher in the elevator shaft than the first level.

12. The method of claim 11, further comprising moving the elevator car to a second level located between the first level and the third level prior to operating the elevator overrun system.

* * * * *